US011805859B2

(12) United States Patent
Pelkofer

(10) Patent No.: US 11,805,859 B2
(45) Date of Patent: Nov. 7, 2023

(54) TENSION MAINTAINING SYSTEM FOR FOOTWEAR LACES

(71) Applicant: Brad Pelkofer, Cranberry Township, PA (US)

(72) Inventor: Brad Pelkofer, Cranberry Township, PA (US)

( * ) Notice: Subject to any disclaimer, the term of this patent is extended or adjusted under 35 U.S.C. 154(b) by 0 days.

(21) Appl. No.: 18/073,668

(22) Filed: Dec. 2, 2022

(65) Prior Publication Data

US 2023/0096798 A1 Mar. 30, 2023

Related U.S. Application Data

(63) Continuation-in-part of application No. 17/474,299, filed on Sep. 14, 2021, which is a continuation-in-part of application No. 29/760,723, filed on Dec. 3, 2020, and a continuation-in-part of application No. 29/760,729, filed on Dec. 3, 2020, and a continuation-in-part of application No. 16/408,033, filed on May 9, 2019, now Pat. No. 11,116,287.

(60) Provisional application No. 63/286,759, filed on Dec. 7, 2021, provisional application No. 63/120,981, filed on Dec. 3, 2020, provisional application No. 62/668,983, filed on May 9, 2018.

(51) Int. Cl.
*A43C 7/04* (2006.01)

(52) U.S. Cl.
CPC ..... *A43C 7/04* (2013.01)

(58) Field of Classification Search
CPC .. A43C 11/20; A43C 7/04; A43C 7/05; A43C 7/00; Y10T 24/3716
USPC ... 24/712.2, 712.3, 712.4, 712.6, 713, 713.2
See application file for complete search history.

(56) References Cited

U.S. PATENT DOCUMENTS

| | | | | | |
|---|---|---|---|---|---|
| 882,479 | A | | 3/1908 | Nicholls | |
| 2,611,940 | A | * | 9/1952 | Cairns | A43C 7/00 24/712.9 |
| 3,108,385 | A | * | 10/1963 | Teufel | A43C 3/04 24/712.7 |
| RE31,052 | E | * | 10/1982 | Adams | A43C 1/003 36/50.1 |
| 4,507,878 | A | * | 4/1985 | Semouha | A43C 1/00 36/50.1 |
| 6,029,323 | A | * | 2/2000 | Dickie | A43C 7/04 24/712.1 |
| 9,468,262 | B2 | * | 10/2016 | Caron | A43C 7/005 |
| 9,743,713 | B1 | | 8/2017 | Lam | |
| 11,583,035 | B2 | * | 2/2023 | Dombrow | A43C 11/22 |
| 2009/0126227 | A1 | * | 5/2009 | Rivas | A43C 3/00 36/50.1 |

(Continued)

OTHER PUBLICATIONS

World Intellectual Property Organization, Written Opinion of the International Searching Authority, PCT App. No. PCT/US22/51615, dated Mar. 20, 2023.

*Primary Examiner* — Ted Kavanaugh
(74) *Attorney, Agent, or Firm* — Indiana University Maurer School of Law Intellectual Property Legal Clinic

(57) ABSTRACT

A clamp includes a cap, a base, a plurality of staggered protrusions on the base and the cap, a hinge, and a latch. The hinge is defined by the cap and the base. The latch is configured to secure the cap to the base. A footwear includes laces on the footwear, an upper, and at least one aforementioned clamp. The clamp attaches to the upper and the laces, securing the laces. The clamp may be repositioned and may be removable.

18 Claims, 12 Drawing Sheets

(56) References Cited

U.S. PATENT DOCUMENTS

| | | | | |
|---|---|---|---|---|
| 2009/0236870 | A1* | 9/2009 | Duncan | B60J 7/141<br>296/136.04 |
| 2012/0291242 | A1 | 11/2012 | Donnadieu | |
| 2013/0160256 | A1 | 6/2013 | Waldman et al. | |
| 2014/0020263 | A1 | 1/2014 | Theuvenet et al. | |
| 2014/0325873 | A1* | 11/2014 | Linth | A43C 3/00<br>36/50.1 |

* cited by examiner

TENSION MAINTAINING SYSTEM FOR FOOTWEAR LACES

RELATED APPLICATIONS

The present application claims the benefit of U.S. Provisional Application No. 63/286,759, filed Dec. 7, 2021, naming Brad Pelkofer, and titled "Tension Maintaining System for Footwear Laces;" and claims priority to U.S. Non-provisional patent application Ser. No. 17/474,299, filed Sep. 14, 2021, naming Brad Pelkofer et al., and titled "Tension Maintaining System for Footwear Laces," which claims priority to U.S. Non-provisional patent application Ser. No. 16/408,033 (now U.S. Pat. No. 11,116,287), filed May 5, 2019, naming Brad Pelkofer et al., and titled "Tension Maintaining System for Footwear Laces," which claims the benefit of U.S. Provisional Patent Application No. 62/668,983, filed May 9, 2018, naming Brad Pelkofer et al., and titled "Tension Maintaining System for Footwear Laces;" U.S. Design patent application Ser. No. 29/760,723, filed Dec. 3, 2020, naming Brad Pelkofer et al., and titled "Tension Maintaining System for Footwear Laces;" U.S. Design patent application Ser. No. 29/760,729, filed Dec. 3, 2020, naming Brad Pelkofer et al., and titled "Tension Maintaining System for Footwear Laces;" and claims the benefit of U.S. Provisional Patent Application No. 63/120,981, filed Dec. 3, 2020, naming Brad Pelkofer et al., and titled "Tension Maintaining System for Footwear Laces," the entire disclosures of which are expressly incorporated by reference herein.

TECHNICAL FIELD

The present disclosure is directed to an adjustable clamp device for maintaining tension in the laces of footwear.

BACKGROUND AND SUMMARY OF THE DISCLOSURE

The following statements are intended to facilitate an understanding of the present disclosure. The statements are to be read in this light and should not be construed as admissions of prior art.

Laces are a common footwear feature that help individuals securely maintain shoes, cleats, skates, or other footwear on their feet. After the laces are tightened and tied, maintaining lace tension on a piece of footwear can be challenging when a user engages in significant amounts of movement or activity.

According to the present disclosure, a footwear is provided that comprises a sole, an upper supported by the sole, and at least one lace coupled to the upper. The at least one lace has a plurality of lace portions. The footwear further comprises at least one clamp that couples at least two lace portions together.

According to the present disclosure, a footwear is provided that comprises a sole, an upper supported by the sole, and at least one lace coupled to the upper. The at least one lace has a plurality of lace portions. The footwear further comprises at least one rail and a lace-retention unit coupled to the at least one rail that couples at least two lace portions together.

According to the present disclosure, a footwear is provided that comprises a sole, an upper supported by the sole, and at least one lace coupled to the upper. The at least one lace has a plurality of lace portions. The footwear further comprises at least one clamp coupled to the upper. The at least one clamp couples at least two lace portions together.

According to the present disclosure, a method of securing two portions of a lace of a footwear is provided. The method comprises the steps of providing a footwear having a sole, an upper supported by the sole, at least one lace coupled to the upper, and at least one clamp. The method further comprises positioning the at least one clamp on the upper, clamping the at least one clamp to the at least one lace, and repositioning the at least one clamp along the upper.

According to the present disclosure, a method of securing two portions of a lace of a footwear is provided. This method comprises the steps of providing a footwear having a sole, an upper supported by the sole, at least one lace coupled to the upper, a tongue attached to the upper, and at least one clamp. The method further comprises positioning the at least one clamp on the tongue, clamping the at least one clamp to the at least one lace, and substantially preventing lateral movement of the tongue with the at least one clamp.

Additional features of the present disclosure will become apparent to those skilled in the art upon consideration of the following detailed description of the illustrative embodiment exemplifying the best mode of carrying out the disclosure as presently perceived.

BRIEF DESCRIPTION OF THE DRAWINGS

The detailed description of the drawings particularly refers to the accompanying figures in which.

Figure 1:
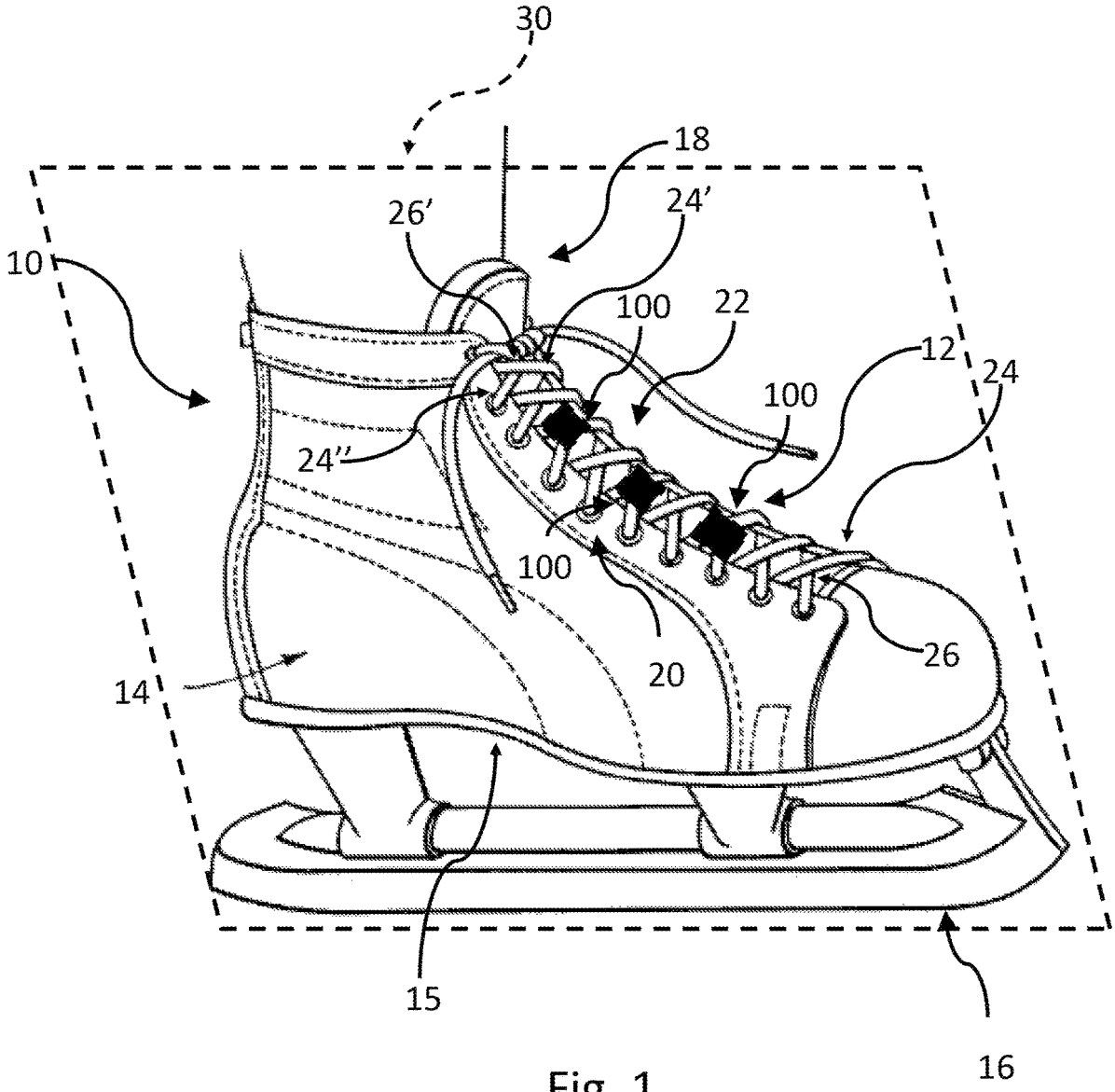
FIG. 1 is a perspective view of a skate with laces forming an X-shape or crisscross pattern when the laces are tightened, and three diagrammatic clamps coupled to a tongue of the skate and positioned to clamp crisscrossed portions of the laces together.

For the purposes of promoting an understanding of the principals of the disclosure, reference will now be made to the embodiments illustrated in the drawings, which are described below. The embodiments disclosed below are not intended to be exhaustive or limit the disclosure to the precise form disclosed in the following detailed description. Rather, the embodiments are chosen and described so that others skilled in the art may utilize their teachings. Unless otherwise indicated or apparent, the components shown in the figures are proportional to each other. It will be understood that no limitation of the scope of the disclosure is thereby intended. The disclosure includes any alterations and further modifications in the illustrative devices and described methods and further applications of the principles of the disclosure, which would normally occur to one skilled in the art to which the disclosure relates.

DETAILED DESCRIPTION OF THE DRAWINGS

In FIG. 1, an ice skate 10, one type of footwear, is shown. Skate 10 includes an upper portion or upper 12 having a tongue 18, a heel 14, a sole 15, a blade 16 attached to sole 15, eyelets or attachments 20 provided on upper 12, and lace 22. A sagittal plane 30 of upper 12 divides skate 10 into left and right sections. Lace 22 is used to tighten upper 12 and is arranged in a pattern through attachments 20. In one embodiment, lace 22 is tied in an X-shape or crisscross pattern 26 as shown in FIG. 1. Attachments 20 may be provided in forms other than eyelets. For example, attachments 20 may be loops attached to upper 12.

A lace-retention unit 100 (See FIGS. 1 and 2) is shown diagrammatically in the form of a retention clamp 100 on tongue 18 of skate 10 in FIG. 1. When retention clamp 100 is applied to crisscrossed lace 22 of skate 10 and clamped, lace 22 is clamped together to reduce or eliminate movement of lace 22 to assist in maintaining the tightness of lace 22. In some embodiments, including the preferred embodiment of the present disclosure, upper 12 includes tongue 18 and clamp 100 attaches to tongue 18 of upper 12. Clamp 100 may prevent lateral movement of tongue 18. According to other embodiments, the upper is tongueless and clamp 100 attaches to the upper without attaching to a tongue. In some embodiments, clamp 100 is detachable and may be positioned and repositioned along upper 12, including tongue 18. In other embodiments, clamp 100 is permanently attached, but may still be positioned and repositioned along upper 12, including tongue 18.

Lace 22 includes a plurality of lace portions 24 that extend from attachments 20. Pairs of lace portions 24 often cross to form an X-shape 26. Retention clamp 100 clamps one or more of these pairs of lace portions 24 together. Often, a pair of attachments 20 are positioned adjacent one another on opposite sides of tongue 18. An upper-most X-shape 26' is defined by a pair of lace portions 24 that includes a first upper-most lace portion 24' that extends down from a first upper-most attachment 20 (e.g. on the left side of tongue 18) and a second upper-most lace portion 24" that extends down from a second upper-most attachment 20 (e.g. on the right side of tongue 18). As shown in FIG. 1, clamps 100 are positioned below first and second upper-most attachments 20. As shown in FIG. 1, attachments 20 are provided in pairs that are at the same height on footwear 10. In other embodiments, attachments 20 may be staggered so that a first upper-most attachment 20 on the left side is higher (or lower) than a second upper-most attachment on the right side. Types of footwear 10 include, but are not limited to, skates, boots, such as hunting, military, or hiking boots, and athletic shoes, such as running shoes, tennis shoes, cleats, or basketball shoes.

Figure 2:
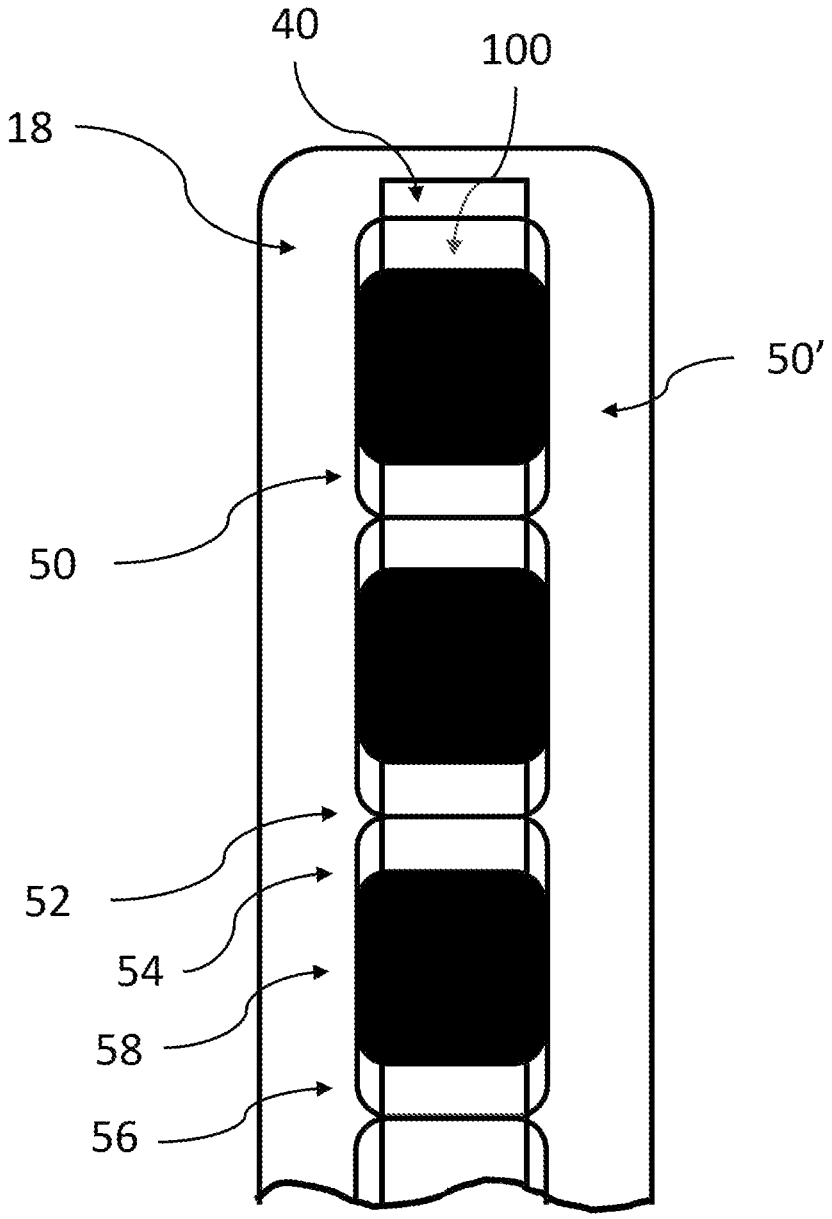
FIG. 2 is a top view of the tongue of the skate of FIG. 1, showing the diagrammatic clamps aligned on a base and two substantially parallel rails defined by a series of loops.
Figure 3:
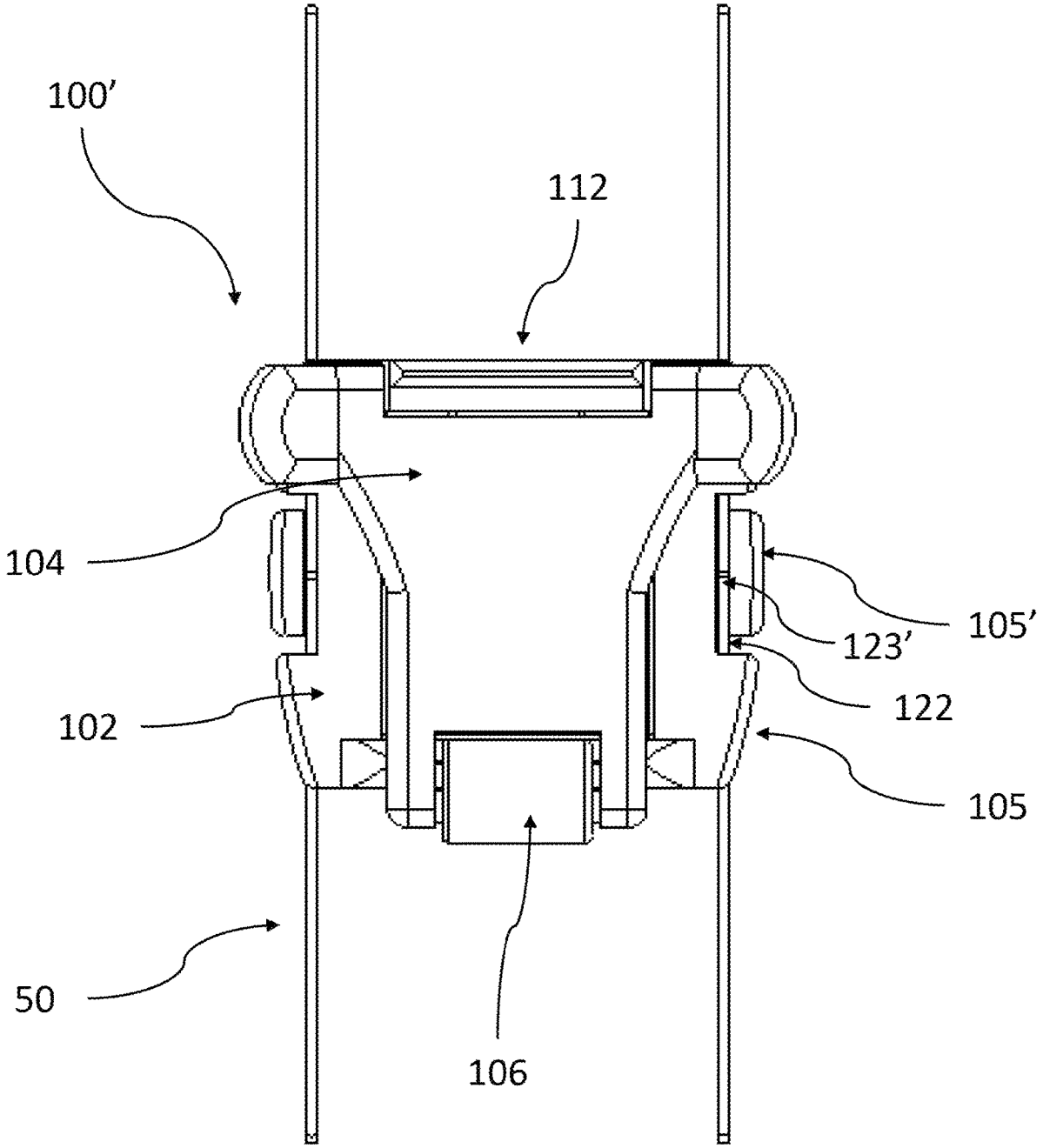
FIG. 3 is a top view of an exemplary embodiment clamp attached to rails similar to those of FIG. 2.
Figure 4:
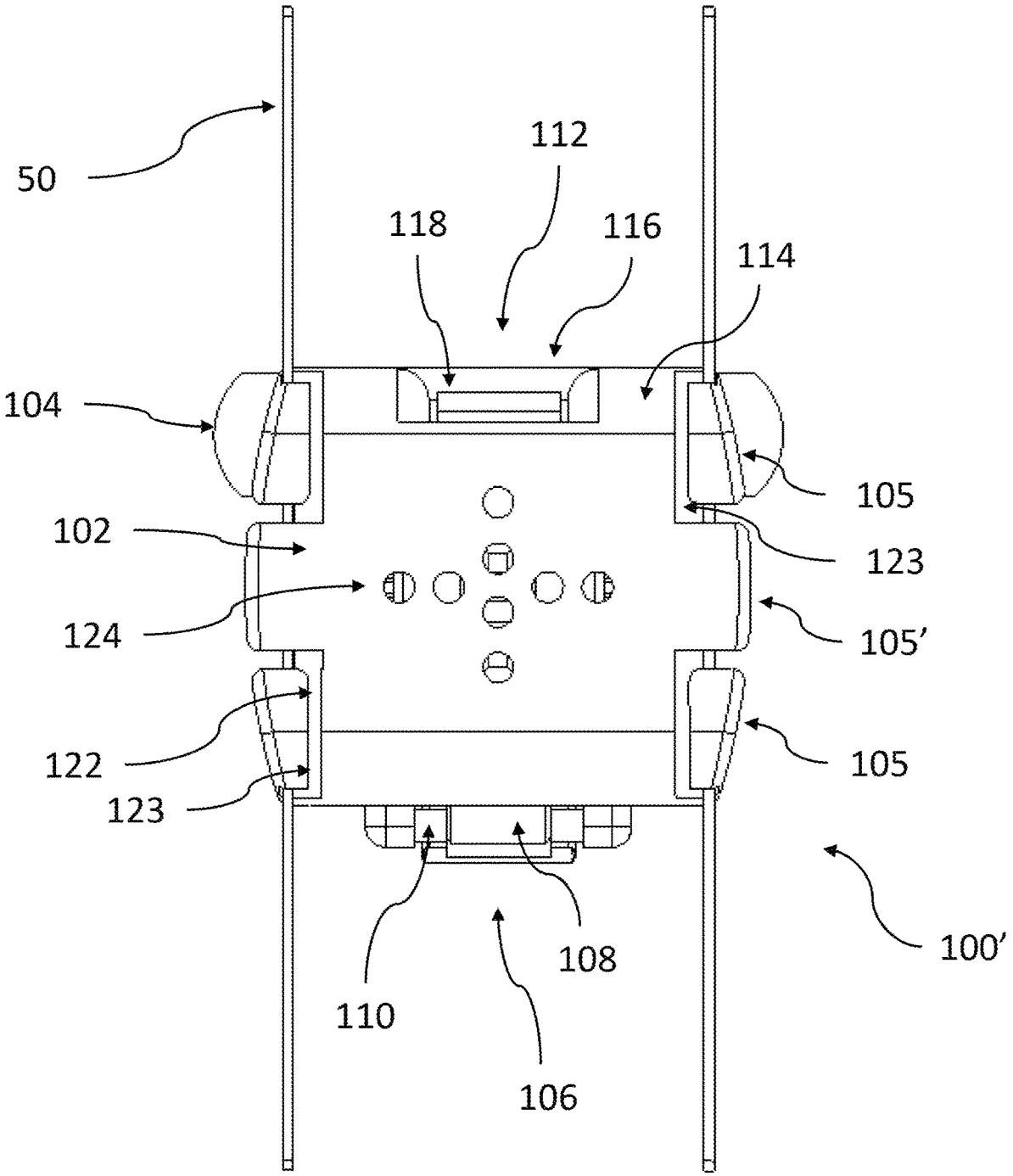
FIG. 4 is a bottom view of the clamp of FIG. 3 attached to the rails.
Figure 5:
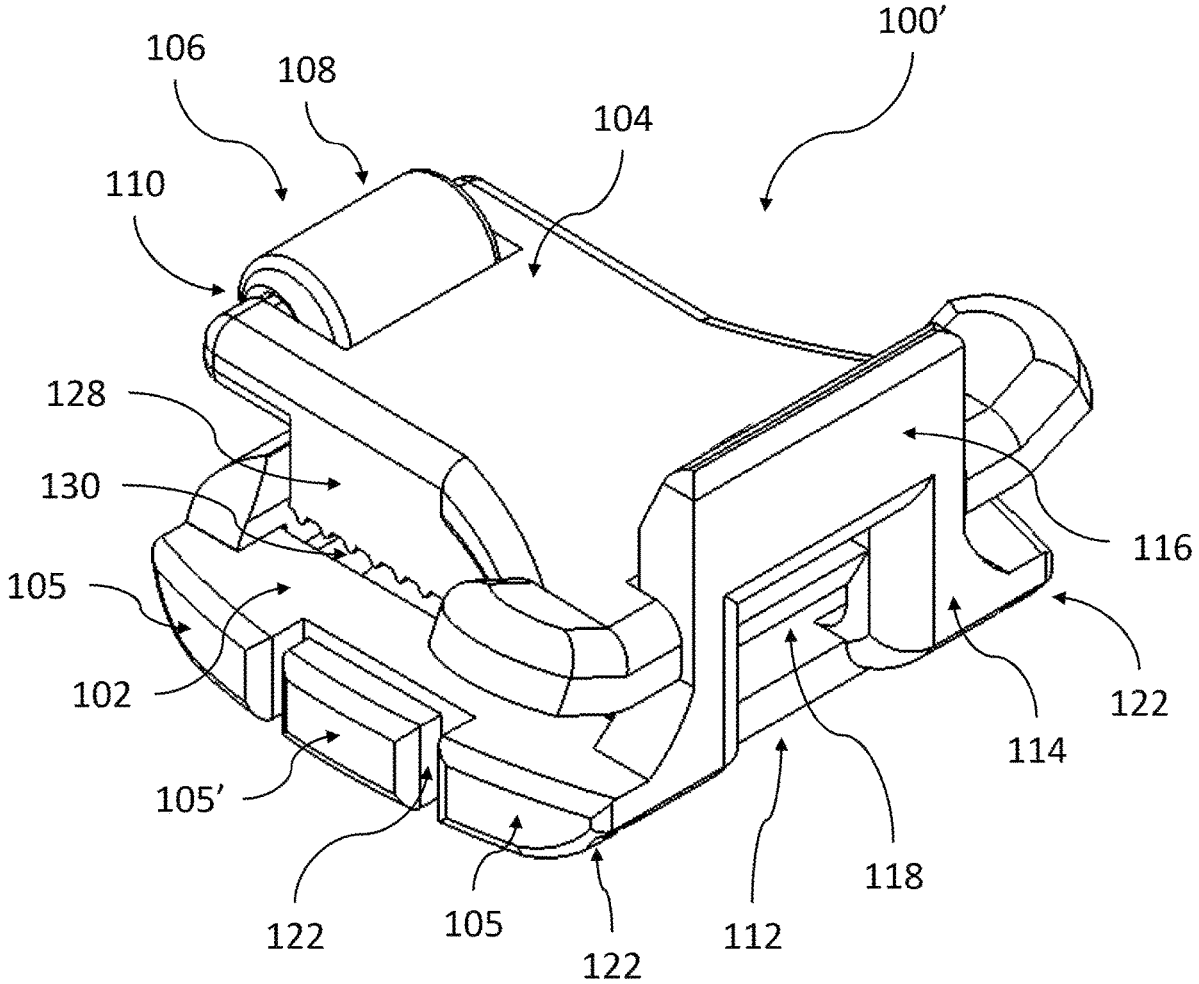
FIG. 5 is a perspective view of the clamp of FIG. 3 partially showing channels configured to receive the rails.

FIG. 2 shows a portion of tongue 18 of footwear 10. In some embodiments, tongue 18 of upper 12 (or a tongueless upper) has a pair of rails 50 to guide, orient, and retain clamps 100 on footwear 10. Clamps 100 ride on rails 50 to allow clamps 100 to move up or down relative to tongue 18 and laces 22 in a predetermined orientation. Additionally, according to the preferred embodiment, rails 50 are flexible, allowing side to side movement of clamps 100 relative to tongue 18 and lace 22 if clamps 100 are open (as discussed below) in a predetermined orientation. However, the up and down movement of clamps 100 is limited by rails 50. According to the present disclosure, tongue 18 has two substantially parallel rails 50 with three adjustably spaced clamps 100. According to alternative embodiments of the present disclosure, fewer or more rails 50 and/or clamps 100 may be provided.

In some embodiments, rails 50 are attached to a base 40, such as a flexible, woven nylon strap/webbing. Base 40 is attached to tongue 18 via stitching, adhesive, etc. to attach rails 50 to tongue 18. According to alternative embodiments, other materials may be used for the base, such a woven or non-woven fabrics, plastic sheets, leather, etc. During attachment of base 40 to tongue 18, tongue 18 may or may not be attached to the remainder of footwear 10. In alternative embodiments, rails 50 may attach directly to tongue 18 of upper 12 (or a tongueless upper) without the use of a base.

Rails 50 may be segmented with each segment 50' containing a single clamp 100. For example, rails 50 of FIG. 2 includes four segments 50' for four clamps 100 (only three shown). According to alternative embodiments, fewer or more segments 50' may be provided on rails 50.

According to some embodiments, segments 50' are provided by loops 52. Loops 52 include upper and lower ends 54, 56 that are attached to base 40 and sides 58 that are detached from base 40, allowing clamps 100 to ride up and down sides 58 as discussed herein. Upper and lower ends 54, 56 may be stitched, adhered, or otherwise attached to base 40 and are spaced apart by about two inches, although other spacing may be provide based on the spacing of lace portions 24 and attachments 20.

Loops 52 are preferably made of a strand, such as low-elasticity synthetic string, including but not limited to upholstery string, fishing line (50 lb. test), etc. A single strand may be used to define loops 52 by crossing the strand over itself between adjacent loops 52. According to alternative embodiments of the present disclosure, other materials may be used to define loops 52, such as cables, metal rings, etc. According to an alternative embodiment, rails 50 are attached to base 40 along substantially all of their lengths and/or are rigid similar to train track rails.

According to some embodiments, sides 58 of loops 52 have some slack, permitting limited side-to-side movement of clamps 100 relative to base 40, lace portions 24, etc. Thus, if the intersection of laces portions 24 defining X-shape 26 are not centered on tongue 18, clamps 100 may move relative to tongue 18 to be centered on X-shape 26.

Clamps 100 can be attached on rails 50 by at least two methods. A first method comprises attaching rails 50 and rail loops 52 onto tongue 18 (or a tongueless upper) via base 40, and removably attaching clamps 100 to rails 50 either before or after attaching rails 50 to tongue 18 (or a tongueless upper) via base 40. If clamps 100 need replacement, they can be removed (as described herein in greater detail for one embodiment of clamps 100) and new clamps 100 installed on rails 50. According to the second method, clamps 100 are permanently attached to rails 50 (as described herein in greater detail) and may be added one-by-one onto rails 50 as rail loops 52 are created.

As shown in FIGS. 3-9, one preferred embodiment clamp 100' is provided. Clamp 100' includes a base 102 that rides along rail 50 and cap 104 that moves from an open position to a closed position clamping laces 22. Although not shown, rails 50 used with clamp 100' are attached to base 40 as shown in FIG. 2 and preferably form loops 52 as also shown in FIG. 2. In the curved edges of base 102, base 102 has a plurality of channels 122 that interact with rails 50 to securely hold clamp 100' on base 102 and tongue 18 of footwear 10.

Base 102 includes outer and inner lugs 105, 105' through which rail 50 is threaded during manufacturing or later by a user, etc. To attach clamp 100' to one of rails 50, rail 50 is positioned under outer lugs 105 and over inner lug 105'. Outer lugs 105 define downward facing portions 123 of channels 122 and inner lug 105' defines upward facing portion 123' of channel 122. During attachment of clamp 100' to rail 50, rail 50 is maneuvered under one of outer lugs 105 into downward facing portion 123 of channel 122 in that outer lug 105, over inner lug 105' into upward facing portion 123' of channel 122 in inner lug 105', and under the opposing outer lug 105 into downward facing portion 123 of channel 122 in opposing outer lug 105. When threading of rail 50 is complete, rail 50 will be substantially straight through channels 122 on each side of base 102, allowing for clamp 100' upward and downward adjustment along rails 50 along with side-to-side movement. However, rails 50 constrain the upper, lower, and side-to-side limits of the movement of clamp 100'.

Figure 9A:
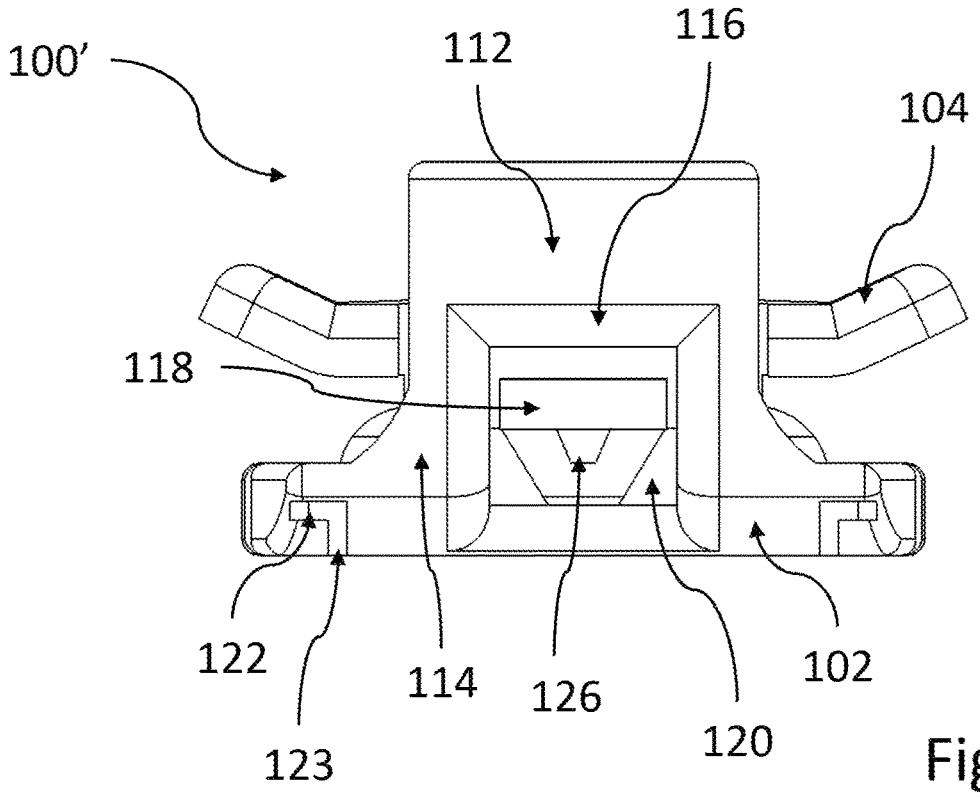
FIG. 9*a* is a front view of the clamp of FIG. 3 in the closed position showing the channels configured to receive the rails.
Figure 9B:
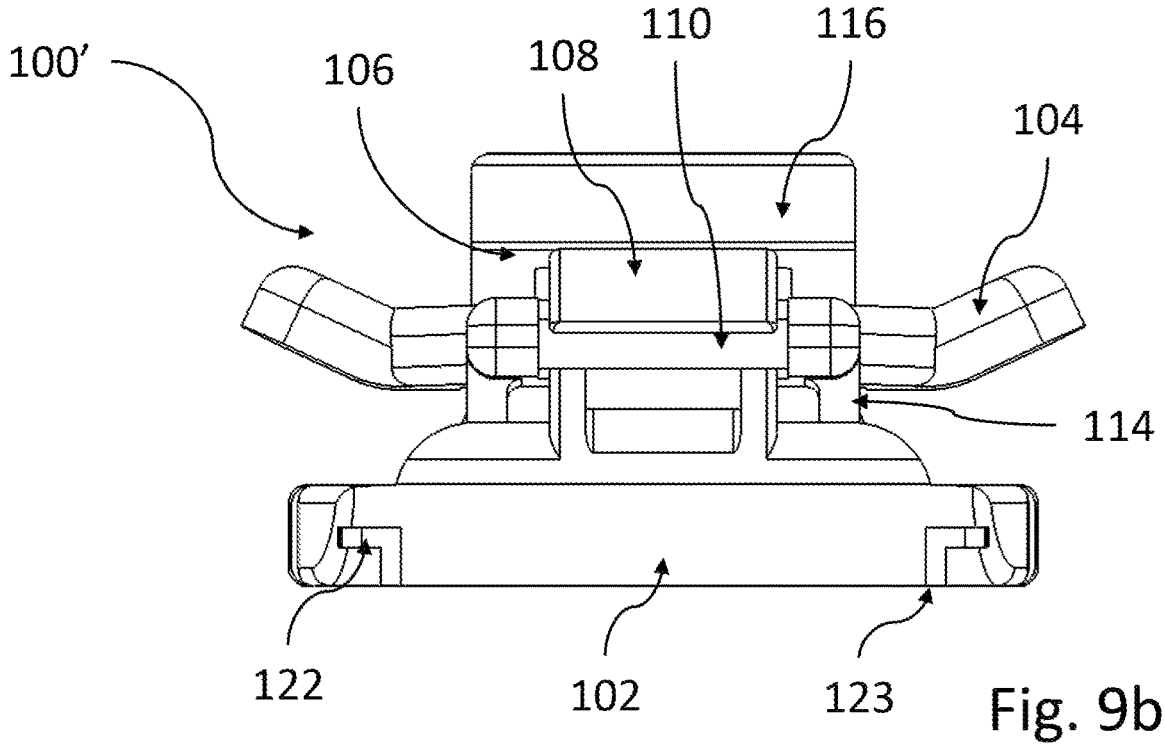
FIG. 9*b* is a rear view of the clamp of FIG. 10 in the closed position showing the channels configured to receive the rails.
Figure 10:
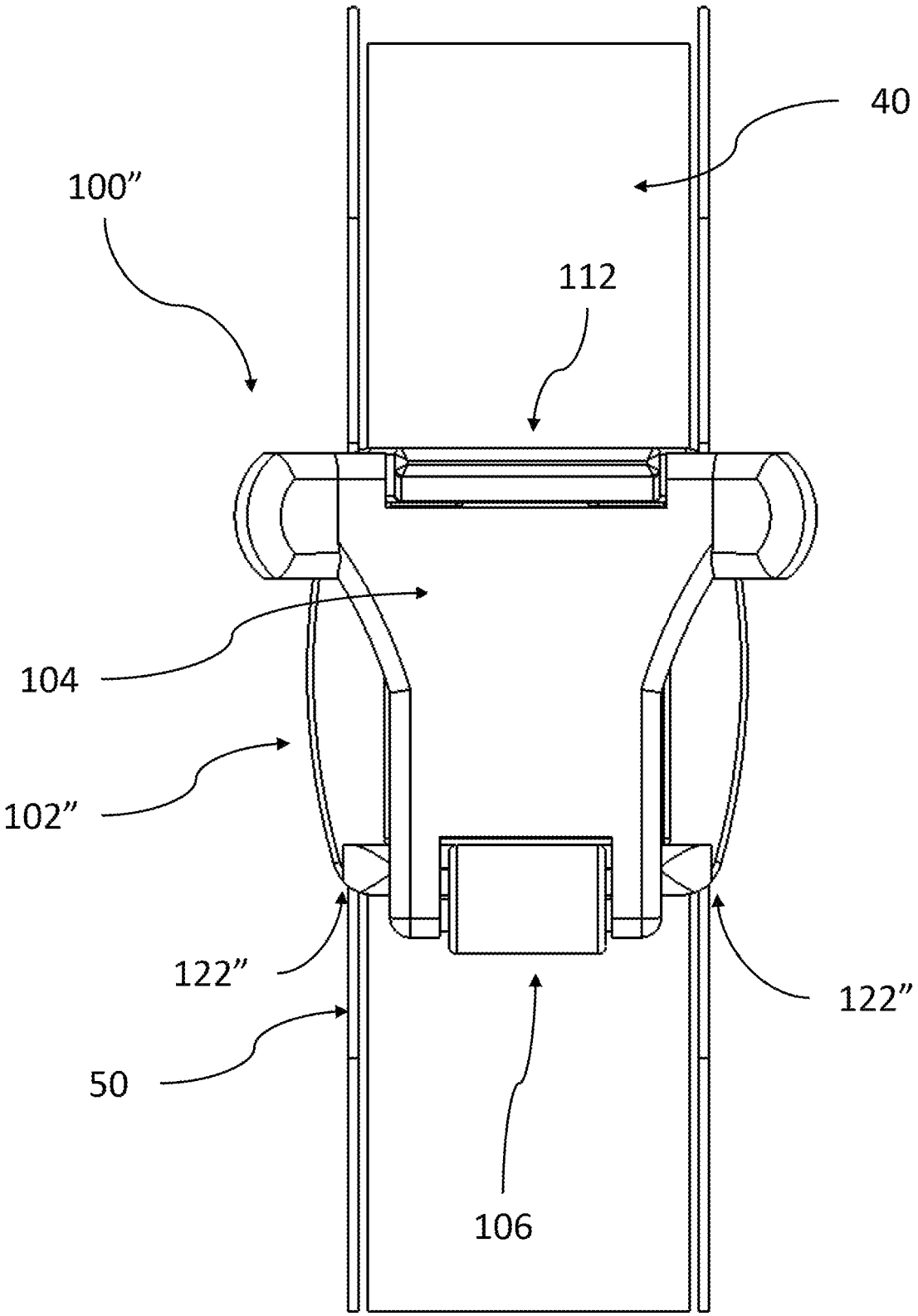
FIG. 10 is a top view of an alternate embodiment clamp attached to a base and rails similar to those of FIG. 2.
Figure 11:
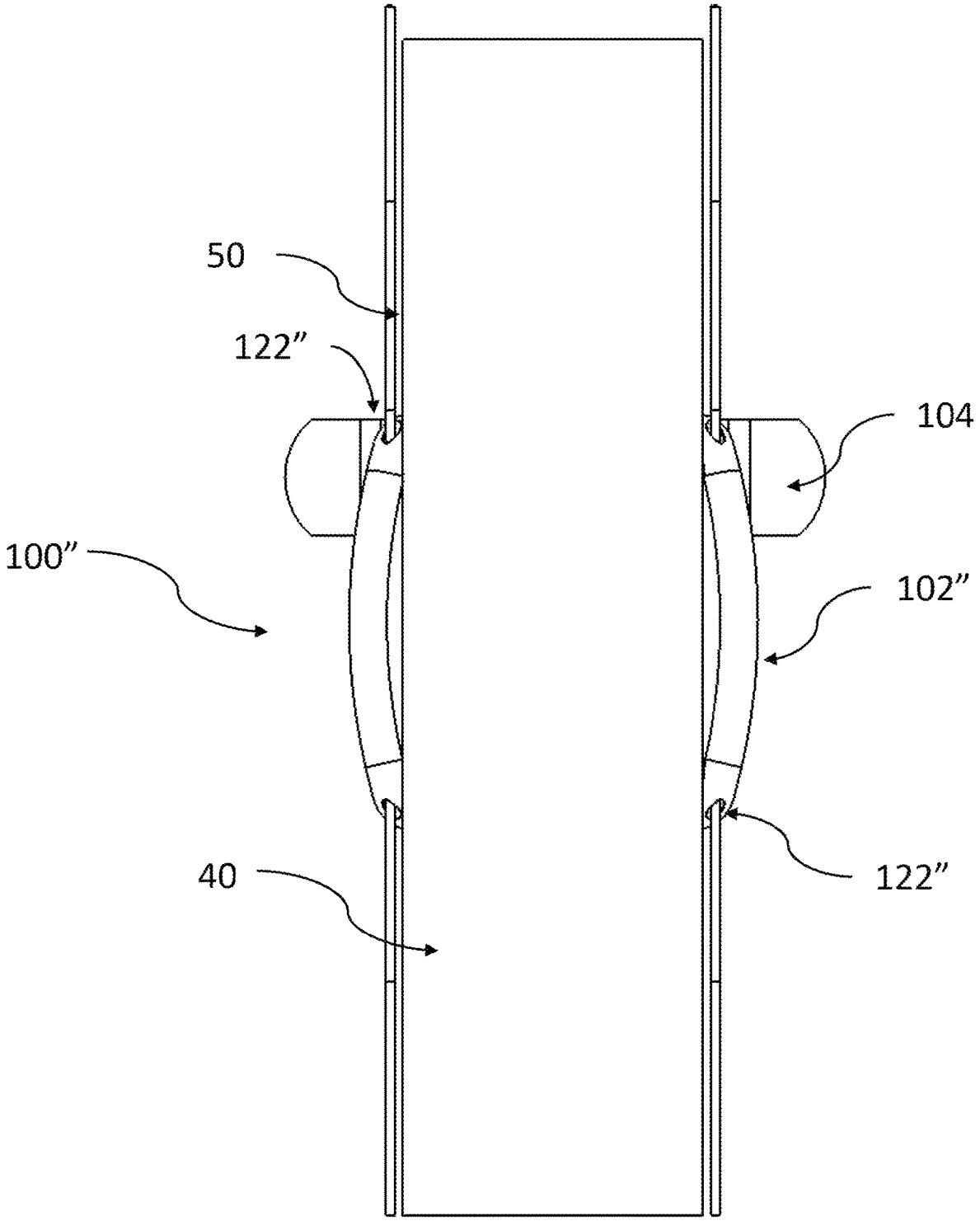
FIG. 11 is a bottom view of the clamp of FIG. 10 attached to the rails and the base.
Figure 12A:
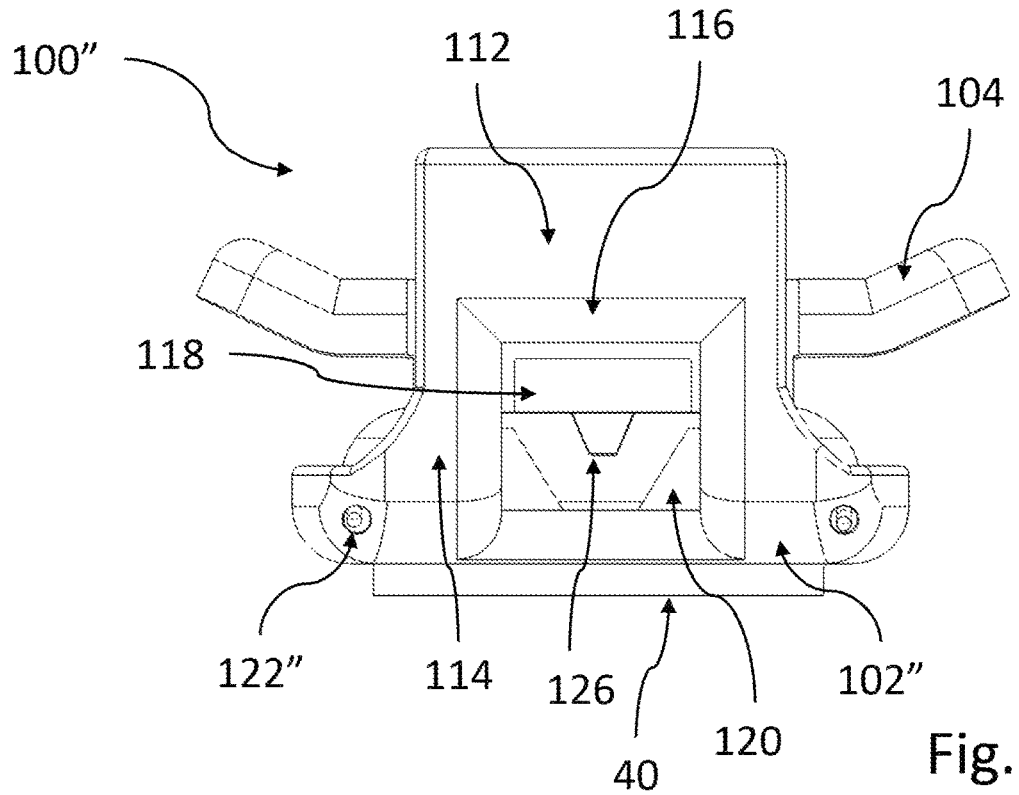
FIG. 12*a* is a front view of the clamp of FIG. 10 in the closed position showing the channels configured to receive the rails.
Figure 12B:
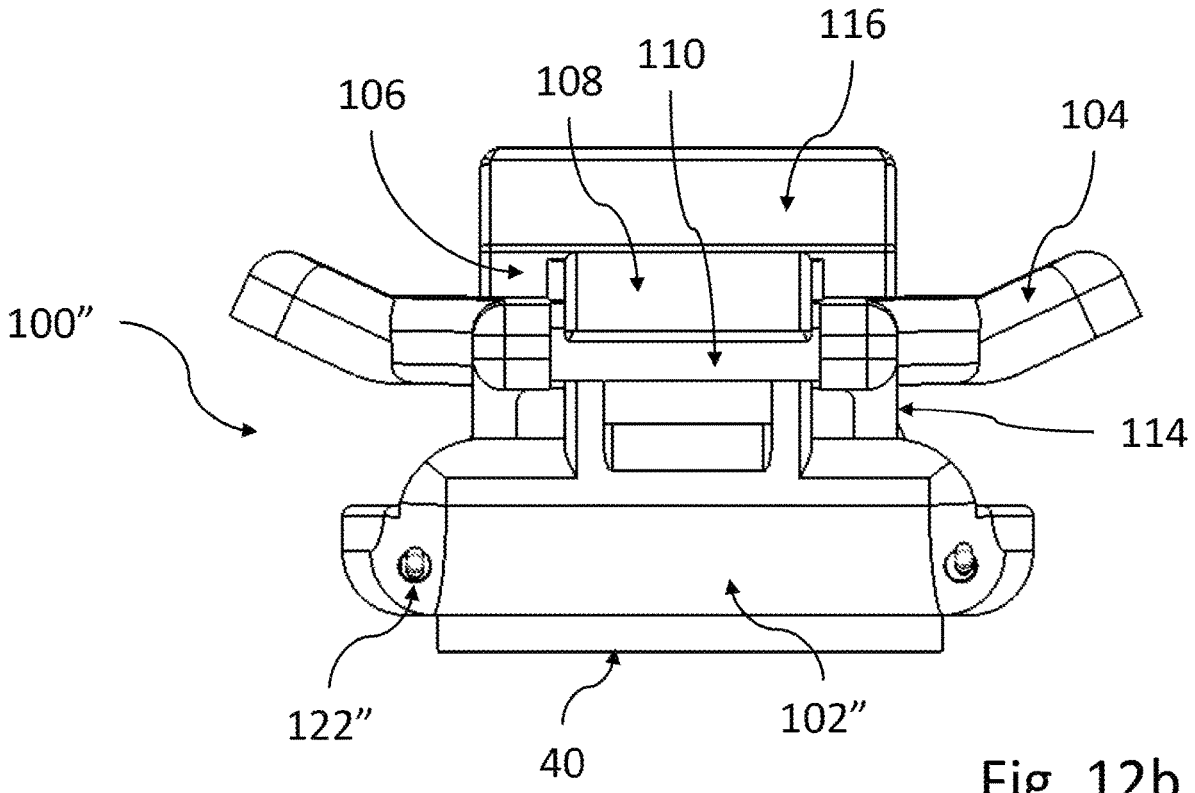
FIG. 12*b* is a rear view of the clamp of FIG. 10 in the closed position showing the channels configured to receive the rails.

According to the present disclosure, portions 123 of channels 122 in outer lugs 105 are L-shaped as shown in FIGS. 9*a* and 9*b* and portion 123' in inner lug 105' is straight. During attachment of clamp 100' to rail 50, rail is inserted into portions 123 of channels 122 and then outward to align with portion 123' of channel 122.

As shown in FIGS. 5-10, clamp 100' includes base 102 and cap 104 pivotally coupled to base 102. Base 102 and cap 104 cooperate to define a hinge 106 including a barrel portion 108 formed on base 102 and a pin portion 110 formed on cap 104. Hinge 106 allows clamp 100 to move between an open position shown in FIG. 6, FIG. 7 and a closed position shown in FIG. 5, FIG. 8. Base 102 and cap 104 also cooperate to define a snap-fit latch 112 including a lever 114 with a catch 116 formed on base 102 and a protruding head 118 formed on cap 104 that fits inside catch 116 on lever 114. During latch 112 movement from the open to closed configurations, lever 114 flexes as catch 116 of lever 114 ramps against head 118, snapping into position once head 118 is positioned inside catch 116 to hold cap 104 in the position shown in FIG. 5. To release cap 104 from the closed position, a user pulls lever 114 in a direction away from catch 116, so head 118 is no longer positioned inside catch 116, allowing cap 104 to move to the open configuration.

Figure 6:
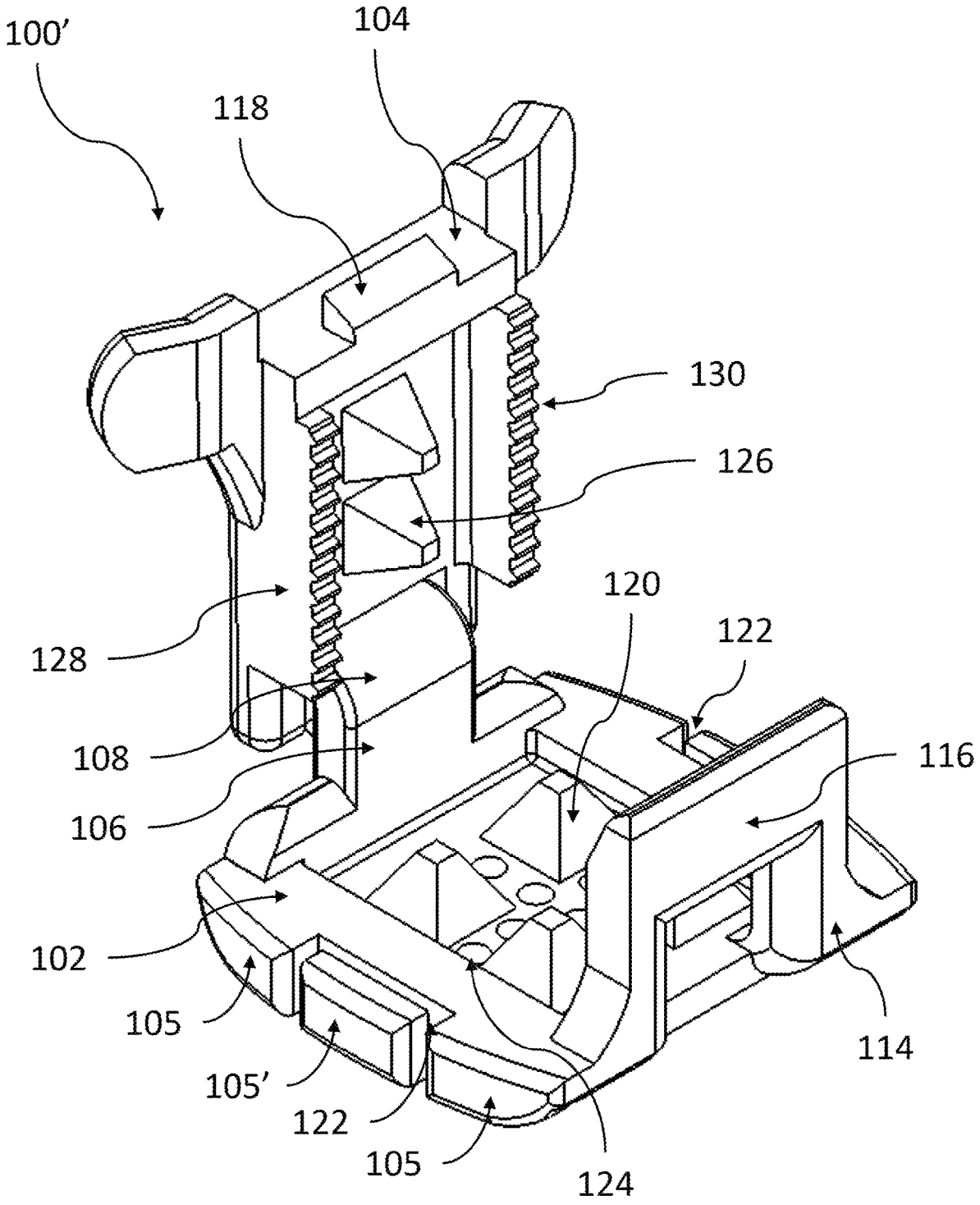
FIG. 6 is a perspective view of the clamp of FIG. 3 in an open position.
Figure 7:
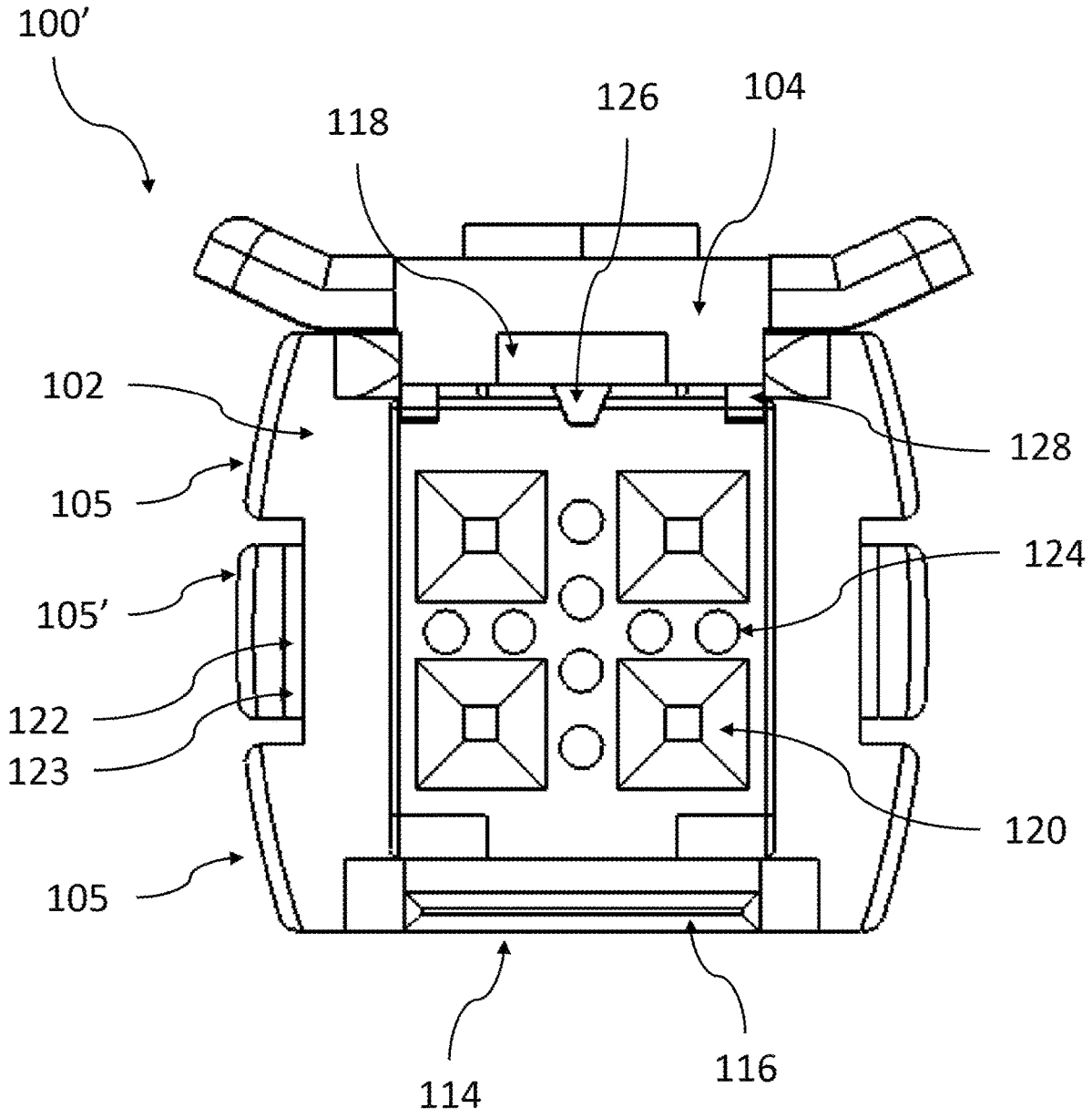
FIG. 7 is a top view of the clamp of FIG. 3 in the open position.
Figure 8:
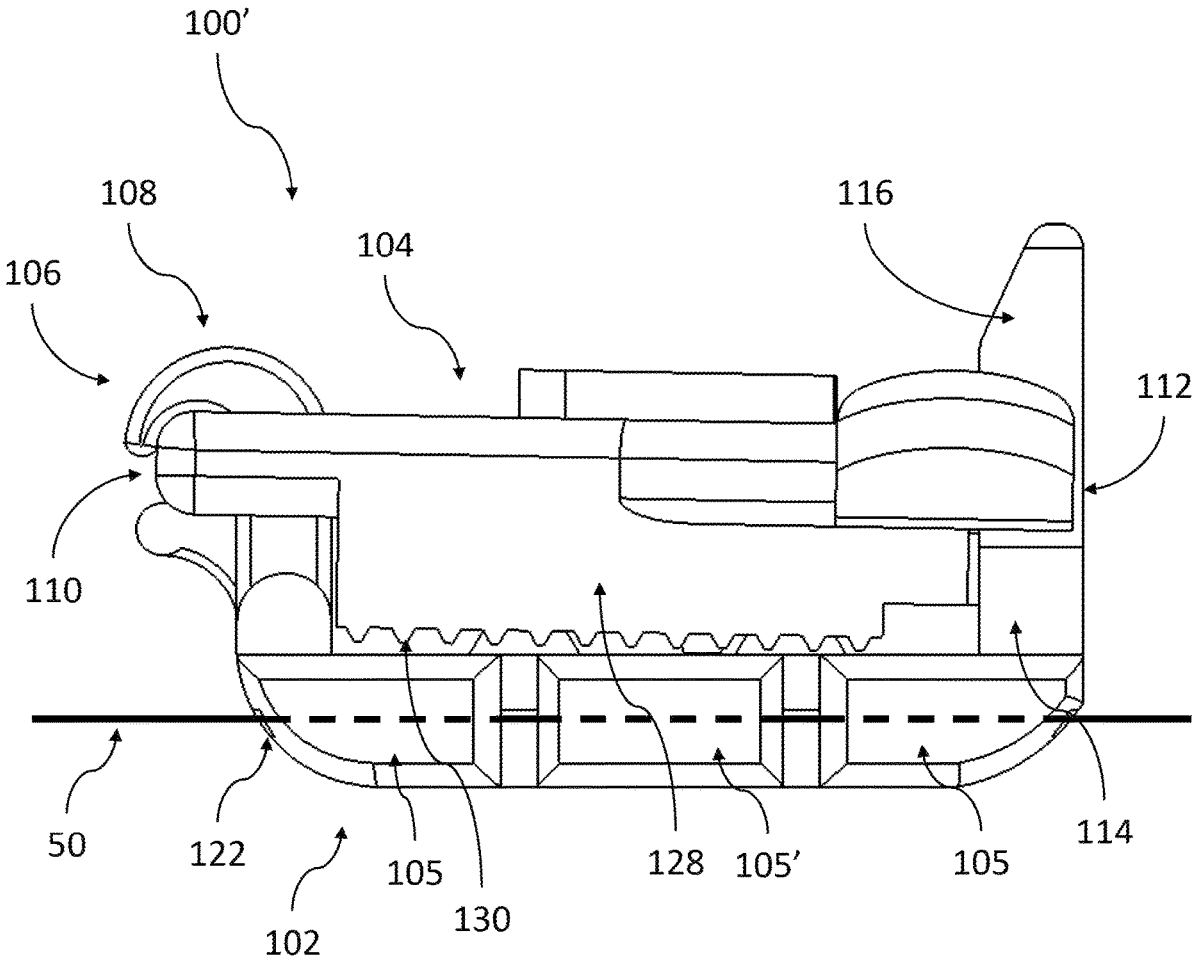
FIG. 8 is a side view of the clamp of FIG. 3 in the closed position showing one of the rails extending through the clamp.

As shown in FIGS. 6 and 7, base 102 and cap 104 include staggered sets 120, 126 of teeth. According to the present disclosure, sets 120, 126 of teeth are square pyramid shaped with flattened tops. Alternative embodiments may employ a variety of other teeth 120, 126 shapes such as triangular, square, hemispherical, etc. with pointed, flat, rounded, etc. tops. When base 102 and cap 104 of clamp 100' are moved between opened and closed configurations, sets 120, 126 of teeth move toward and away from each other. In the closed position, teeth 120, 126 clamp down on laces 22 to maintain tension. To further assist this process, cap 102 includes a pair of plate shaped arms 128 positioned on each side of teeth 126. Arms 128 of cap 102 include teeth 130 which assist teeth 120, 126 in maintaining the tension of laces 22. Additional details of clamp 100' are provided in U.S. patent application Ser. No. 17/474,299 to Brad Pelkofer et al., filed Sep. 14, 2021, titled "Tension Maintaining System for Footwear Laces," the entire disclosure of which is expressly incorporated by reference herein along with the disclosures of the other applications mentioned herein.

Base 102 has a plurality of holes 124. According to the present disclosure, holes 124 are arranged in a cross pattern. Holes 124 can allow base 102 of clamp 100 to be directly attached to tongue 18 of footwear 10. The attachment of base 102 to tongue 18 through holes 124 can be established by stitching/sewing through holes 124 with different threads, lines, or string. Alternatively, rivets, screws, bolts, or other fasteners comprised of plastic, metal, etc. could be used to secure base 102 to tongue 18 through holes 124.

In use, the user adjusts clamp 100' along rails 50, positions base 102 against tongue 18 of skate 10 with cap 104 in the open configuration. Next, the user positions one portion of lace 22 under arms 128, teeth 126 and over teeth 120. Next, the user positioned another portion of lace 22 under arms 128, teeth 126 and over teeth 120 to form X-shape 26 with the other portion of lace 22 as shown in FIG. 1. Preferably, lace 22 is tightened to a desired amount. Finally, cap 104 is moved to the closed position so that the portions of lace 22 are trapped between sets 120, 126, 130 of teeth, holding lace 22 in the tightened position. According to the preferred method of using clamps 100', multiple clamps 100' may be provided on each skate 10 as shown in FIG. 1. When multiple clamps 100 are provided, clamps 100' are closed from a bottom of lace 22 toward a top of lace 22 so that lace 22 can be tightened from the bottom to the top and lace 22 can be tied. Clamps 100 are unclamped as described above to allow loosening of lace 22.

According to an alternative method, lace 22 may be completely tightened and tied before clamps 100' are positioned and closed. When using this method, lace portions 24 are first crisscrossed and base 102 of each clamp 100' is positioned under crisscrossed portions 26 so that crisscrossed portions 26 fit under arms 128. Next, cap 104 is moved to the closed position. Clamps 100' are unclamped as described above to allow loosening of lace 22.

To remove clamps 100' from rails 50, rail 50 is removed from upward facing portion 123' of channel 122. Rail 50 is then removed from downward facing portions 123 of channels 122. This process is repeated for each other rail 50 that interacts with clamp 100' and any other clamps 100' to be removed.

To install new clamps 100', the aforementioned removal method is completed and new clamp 100' is attached to rails 50 via the aforementioned installation method.

According to the present disclosure, a method of securing two portions of lace 22 of footwear 10 is provided. The method comprises the steps of providing footwear 10 having sole 15, an upper 12 supported by sole 15, at least one lace 22 coupled to upper 12, and at least one clamp 100. The method further comprises positioning at least one clamp 100 on upper 12, clamping at least one clamp 100 to at least one lace 22, and repositioning at least one clamp 100 along upper 12.

According to the present disclosure, another method of securing two portions of lace 22 of footwear 10 is provided. This method comprises the steps of providing footwear 10 having sole 15, upper 12 supported by sole 15, at least one lace 22 coupled to upper 12, tongue 18 attached to upper 12, and at least one clamp 100. The method further comprises positioning at least one clamp 100 on tongue 18, clamping at least one clamp 100 to at least one lace 22 and substantially preventing lateral movement of tongue 18 with at least one clamp 100.

FIGS. 10-12*b* show an alternative embodiment clamp 100" attached to base 40. Clamp 100" is substantially the same as clamp 100' and interacts with laces 22 and footwear 10 in a substantially similar way. Although not shown, rails 50 used with clamp 100" are attached to base 40 as shown in FIG. 2 and preferably form loops 52 as also shown in FIG. 2. Base 102" of clamp 100" is different than base 102 of clamp 100'. Clamp 100" has continuous channels 122" that extend through base 102" and receive rails 50. Channels 122" allow clamps 100" to be permanently coupled with rails 50.

To attach clamps 100" to rails 50, rails 50 may be fed into channels 122" of clamps 100". During manufacture, rail 50 is formed into loops 52 that separate clamps 100" threaded over rail 50. Loops 52 are secured to base 40 as discussed herein and then base 40, with loops 52 and clamps 100", are attached to tongue 18 of upper 12 (or a tongueless upper). Similarly, rails 50 used with clamps 100' may be attached to base 40 and then base 40, with loops 52, are attached tongue 18 of upper 12 (or a tongueless upper). Clamps 100' may be attached to rails 50 before and/or after base 40, with rails 50, is attached to tongue 18 of upper 12 (or a tongueless upper).

To remove clamps 100" from rails 50, loops 52 of rails 50 may be undone, opened, or severed, allowing clamps 100" to slide off rails 50. The operation and use of clamps 100" is substantially the same as the operation and use for clamps 100' described above.

What is claimed is:

1. A footwear comprising:

a sole;

an upper supported by the sole;

at least one lace coupled to the upper, the at least one lace having a plurality of lace portions, the plurality of lace portions creating at least one X-shape;

at least one clamp coupled to the upper, the at least one clamp clamping at least two lace portions together at the X-shape; and at least one rail, the at least one clamp being coupled to the upper by the at least one rail to permit movement of the at least one clamp on the rail.

2. The footwear of claim 1, wherein the at least one rail includes a pair of rails positioned to retain the at least one clamp.

3. The footwear of claim 2, wherein the pair of rails is positioned to permit the at least one clamp to move up and down relative to the upper.

4. The footwear of claim 1, wherein the at least one rail is positioned proximate to a sagittal plane of the upper.

5. The footwear of claim 1, wherein the at least one rail is flexible.

6. The footwear of claim 1, further comprising a base, the at least one rail being coupled to the base, and the base being coupled to the upper.

7. The footwear of claim 6, wherein the base is flexible.

8. The footwear of claim 6, wherein the base is permanently coupled to the upper.

9. The footwear of claim 6, wherein the at least one clamp is permanently attached to the at least one rail.

10. The footwear of claim 1, wherein the clamp includes lugs, and the lugs are positioned on the at least one rail.

11. The footwear of claim 1, wherein the clamp includes channels, and the at least one rail is positioned in the channels.

12. The footwear of claim 1, wherein the clamps are removably coupled to the at least one rail.

13. The footwear of claim 1, wherein the at least one rail has a plurality of segments.

14. The footwear of claim 13, further comprising at least one loop, the at least one loop defining the plurality of segments.

15. The footwear of claim 14, wherein the at least one loop is made of at least one strand.

16. The footwear of claim 1, wherein the upper includes a tongue and the at least one clamp is stitched to the tongue.

17. A method of securing two portions of a lace of a footwear, comprising the steps of providing a footwear according to claim 1;

positioning the at least one clamp on the upper;

clamping the at least one clamp to the at least one lace; and repositioning the at least one clamp along the upper.

18. A method of securing two portions of a lace of a footwear, comprising the steps of providing a footwear according to claim 1, the footwear further comprising a tongue attached to the upper;

positioning the at least one clamp on the tongue;

clamping the at least one clamp to the at least one lace; and substantially preventing lateral movement of the tongue with the at least one clamp.

* * * * *